US005983498A

United States Patent [19]

Lieberman et al.

[11] Patent Number: 5,983,498

[45] Date of Patent: Nov. 16, 1999

[54] NAIL CLIPPER WITH RECEPTACLE

[76] Inventors: Christopher E. Lieberman, 1129 W. Madison #2, Chicago, Ill. 60607; Terry W. Kreplin, 851 Winmoor Dr., Sleepy Hollow, Ill. 60118

[21] Appl. No.: 08/995,207

[22] Filed: Dec. 19, 1997

Related U.S. Application Data

[63] Continuation-in-part of application No. 08/732,687, Oct. 18, 1996.

[51] Int. Cl.[6] ..... A45D 29/02

[52] U.S. Cl. ..... 30/28; 132/75.5

[58] Field of Search ..... 30/28; 132/75.5

[56] References Cited

U.S. PATENT DOCUMENTS

| | | | |
|---|---|---|---|
| 860,975 | 7/1907 | Havell . | |
| 2,515,852 | 7/1950 | Bilsky . | |
| 2,799,923 | 7/1957 | Senshu . | |
| 2,837,821 | 6/1958 | David . | |
| 4,130,937 | 12/1978 | Kim . | |
| 4,176,449 | 12/1979 | Lee . | |
| 4,380,120 | 4/1983 | Hannon . | |
| 4,519,134 | 5/1985 | Bumbera . | |
| 4,550,496 | 11/1985 | Reinicke . | |
| 4,574,475 | 3/1986 | Lee . | |
| 4,577,754 | 3/1986 | Jones . | |
| 4,602,430 | 7/1986 | Allen, Jr. . | |
| 4,614,031 | 9/1986 | Chen . | |
| 4,640,011 | 2/1987 | Gamble . | |
| 4,648,415 | 3/1987 | Yuan . | |
| 4,731,927 | 3/1988 | Wilson . | |
| 4,776,431 | 10/1988 | Grassi | 30/28 |
| 4,809,431 | 3/1989 | Idema | 30/28 |
| 4,934,050 | 6/1990 | Athalye . | |
| 4,940,136 | 7/1990 | Miller . | |
| 4,956,915 | 9/1990 | Anderson . | |
| 4,964,213 | 10/1990 | Suggs . | |
| 4,982,747 | 1/1991 | Shah . | |
| 4,984,366 | 1/1991 | Powers . | |
| 4,996,771 | 3/1991 | Williams . | |
| 5,010,644 | 4/1991 | Goench . | |
| 5,031,765 | 7/1991 | Chen . | |
| 5,046,606 | 9/1991 | Morelli . | |
| 5,052,416 | 10/1991 | Rommerdale . | |
| 5,072,511 | 12/1991 | Ro . | |
| 5,074,041 | 12/1991 | Wagner . | |
| 5,123,430 | 6/1992 | Davidovitz . | |
| 5,131,146 | 7/1992 | Leninger . | |
| 5,150,521 | 9/1992 | Han . | |
| 5,195,544 | 3/1993 | Campagna . | |
| 5,226,849 | 7/1993 | Johnson . | |
| 5,323,537 | 6/1994 | Ohori . | |
| 5,357,676 | 10/1994 | Bannett . | |
| 5,357,677 | 10/1994 | West . | |
| 5,384,960 | 1/1995 | Tottenham . | |
| 5,392,518 | 2/1995 | Means . | |
| 5,423,124 | 6/1995 | Marrocco . | |
| 5,459,926 | 10/1995 | Perea . | |
| 5,488,772 | 2/1996 | Dababneh . | |
| 5,490,327 | 2/1996 | Ohori . | |
| 5,522,136 | 6/1996 | Larisey . | |
| 5,524,344 | 6/1996 | Bazal . | |
| 5,531,025 | 7/1996 | Albone . | |
| 5,537,747 | 7/1996 | Cacciotti et al. . | |
| 5,546,658 | 8/1996 | MacLeod et al. . | |
| 5,564,189 | 10/1996 | Lee . | |
| 5,570,509 | 11/1996 | Killian . | |
| 5,617,633 | 4/1997 | Lee . | |
| 5,653,024 | 8/1997 | Cartagenova | 30/28 |

FOREIGN PATENT DOCUMENTS

| | | |
|---|---|---|
| 1 201 884 | 3/1986 | Canada . |
| 2040117 | 10/1992 | Canada . |

*Primary Examiner*—Douglas D. Watts
*Attorney, Agent, or Firm*—Wellenstein & Wagner, Ltd.

[57] ABSTRACT

The present invention provides a device for clipping nails and retaining the clippings. The nail clipper includes a lower arm member defining an opening and a cutting edge at an end thereof. The nail clipper further has an upper arm member springingly attached to the lower arm member, the upper arm member further defining a cutting edge in corresponding placement to the cutting edge of the lower arm member. The nail clipper further includes a receptacle for retaining nail clippings, an actuating handle, and, a retaining pin connecting the lower arm member, the upper arm member, the receptacle, and the actuating handle.

21 Claims, 5 Drawing Sheets

63
60
1
61
64
65
66
22
26
20
24
21
11
23
14
10
41
12
15
40
43
44
42
52
53
50
51
54
55

60
63
1
30
61
64
65
28
22
66
62
20
24
21
17
11
23
13
19
10
14
12
100
15
52
53
51
50
54
55
46
40
43
42

NAIL CLIPPER WITH RECEPTACLE

RELATED APPLICATION

This is a continuation-in-part application of U.S. patent application Ser. No. 08/732,687 filed Oct. 18, 1996, which is hereby incorporated herein by reference and made a part hereof.

TECHNICAL FIELD

This invention relates to a nail clipper. More specifically, it relates to a nail clipper which collects and holds nail clippings until a specific time when the clipper can be emptied of its contents.

BACKGROUND OF THE INVENTION

Known are nail clipping devices useful for manicuring or pedicuring purposes. Such devices typically comprise a pair of resilient metal arm members secured together in overlapping engagement at respective first ends of the members and having at second ends thereof blades or shearing elements movable upon actuation of a handle to a position where the blades are set in nail shearing engagement. A fingernail or toenail positioned between the blades can be severed upon actuation of the handle.

A disadvantage of conventional nail clipping devices is that they permit the scattering of nail clippings, such scattering caused by the manner in which the blades or shearing elements operate. Specifically, the blades, when moved to a clamping position, compress the nail, thus flattening its natural curvature. When the nail is clipped, it snaps back to its natural shape and is ejected from the clipper in an unpredictable trajectory.

In order to solve the foregoing disadvantage associated with conventional nail clipping devices, there has been provided receptacles and the like associated with the clippers in which the clippings are prevented from scattering by collecting them for disposal. Such improved nail clipping devices are most often typified in one of two forms.

In the first form, the clipper is encased by a sleeve, that together with the upper and lower arm members, form a compartment to catch nail clippings. U.S. Pat. No. 4,776,090, to Grassi issued Oct. 11, 1988 and U.S. Pat. No. 5,150,521, issued Sep. 29, 1992 to Soo Han are both examples of this type. While both of these inventions prevent the scattering of clippings, they both rely on a removable sleeve as a central part of their design. It is this removable sleeve that is objectionable in that it can be lost or damaged while attempting to empty the receptacle of clippings. The sleeve could also inadvertently become removed from the nail clipper causing the clippings to scatter and obviating the purpose of the invention.

In the second form, the clipper utilizes integral side walls, instead of a removable sleeve, to catch and retain clippings. In U.S. Pat. No. 4,614,031 to Chen issued Sep. 30, 1986, for example, a receptacle is formed by upper and lower arm members. The lower arm member having integral side walls extending vertically towards the upper arm member, and a depression in its midsection where clippings can collect. The principal drawback with this invention is that clippings must be emptied through the front of the device between the cutting blades. Clippings can easily become wedged between the upper and lower arm members or behind the shearing surface, requiring the user to shake the device in order to remove the clippings. This is undesirable because some clippings will be permanently retained in the device and others will discharge in unpredictable trajectories from the device while being shaken, scattering the nail clippings.

SUMMARY OF THE INVENTION

The present invention provides a device for clipping nails which retains the clippings within a receptacle for later disposal. To this end, there is provided a device having an upper arm member and a lower arm member which are operatively connected so that the upper arm member is springingly movable relative to the lower arm member. The upper and lower arm members further define shearing edges which are in corresponding placement. The lower arm member further defines an opening and a pair of sidewalls.

An actuating lever is also provided to assist in moving the upper arm member toward the lower arm member to shear a nail placed between the two cutting edges. The actuating lever is attached to the upper and lower arm members by a retaining pin.

A receptacle is also provided adjacent the opening of the lower arm member for containing nail clippings. The receptacle is rotatably attached to the lower arm member by the retaining pin or by a rivet.

Alternatively, the receptacle can be attached to the lower arm member by two pairs of resilient ribs. One pair of ribs is located within the cavity of the receptacle, and the other pair is located on the outer surface of the sidewalls of the lower arm member. One set of resilient ribs is forced past the other set to attach the receptacle to the lower arm member.

Additionally, the upper arm member could include a pair of sidewalls in place of the sidewalls of the lower arm member, or both the upper and lower arm members could include sidewalls.

The upper and lower arm members may be constructed from a single piece of material or they may be constructed from two separate pieces which are attached. The upper and lower arm members could be attached by a rivet, a screw, an adhesive, or by spot welding. Alternatively, one of the arm members could be bent around the other arm member.

DETAILED DESCRIPTION OF THE PREFERRED EMBODIMENTS

Figure 1:
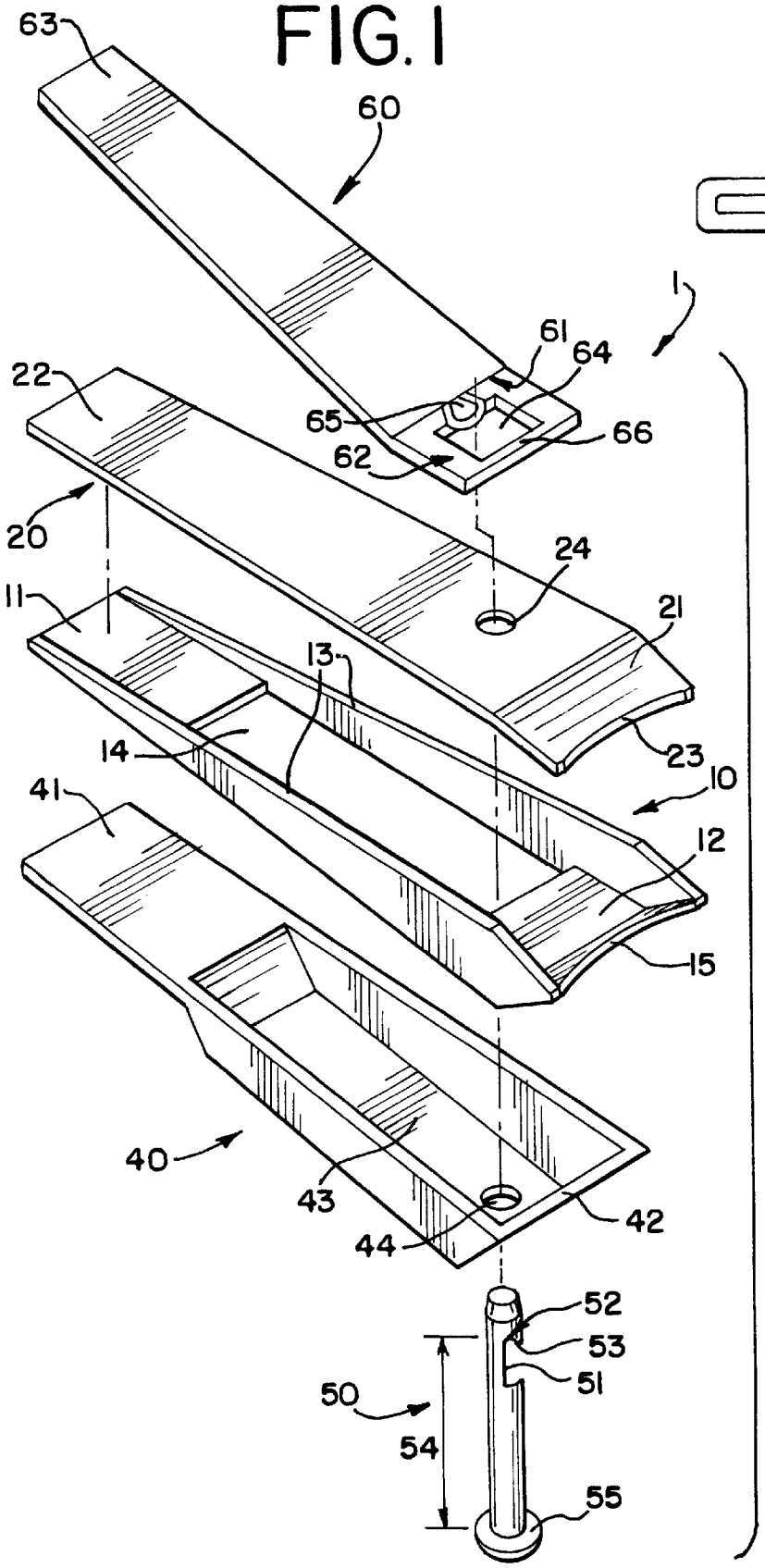
FIG. 1 is an exploded view of a preferred embodiment of the present invention with sidewalls on the lower arm member.

While the invention is susceptible of embodiment in many different forms, there is shown in the drawings and will herein be described in detail a preferred embodiment of the invention. It is to be understood that the present disclosure is to be considered as an exemplification of the principles of the invention. This disclosure is not intended to limit the broad aspect of the invention to the illustrated embodiments.

The present invention provides an improved nail clipper for clipping fingernails and toenails while containing the nail clippings within a receptacle for later disposal, thereby avoiding the mess associated with conventional nail clippers. The clipper of the present invention is described for use with a human's fingernail, but could be used for animals without departing from the scope of the present invention.

Referring to FIG. 1, there is provided a nail clipper 1 comprising a lower arm member 10 which defines a rear section 11 and a front section 12. The front section 12 and rear section 11 are connected by two vertical sidewalls 13 which with the front and rear sections 11, 12 define an opening 14. The front section 11 of the lower arm member 10 also defines a cutting edge 15. While the cutting edge 15 is shown as being arcuate in shape, the cutting edge 15 could also be of any shape, including a straight edge, without departing from the scope of the present invention.

Also provided is an upper arm member 20 which defines a front end 21 and a rear end 22. The upper arm member 20 and the lower arm member 10 form a body 2 and are formed by bending a blank about a centrally positioned fold line to define a bend at rear end 22 of the upper arm member 20 and the rear section 11 of the lower arm member 10.

The front end 21 of the upper arm member 20 is springingly movable with respect to the lower arm member 10 at the bend (not shown). The front end 21 of the upper arm member 20 further defines a cutting edge 23 which corresponds to the cutting edge 15 of the lower arm member 10. The front end 21 of the upper arm member 20 further defines a through-hole 24.

Figure 2:
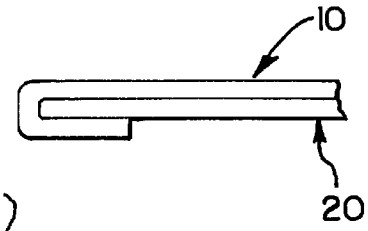
FIG. 2 is a partial view of a preferred embodiment where the upper arm member is attached to the lower arm member by bending the upper arm member around the lower arm member.
Figure 7:
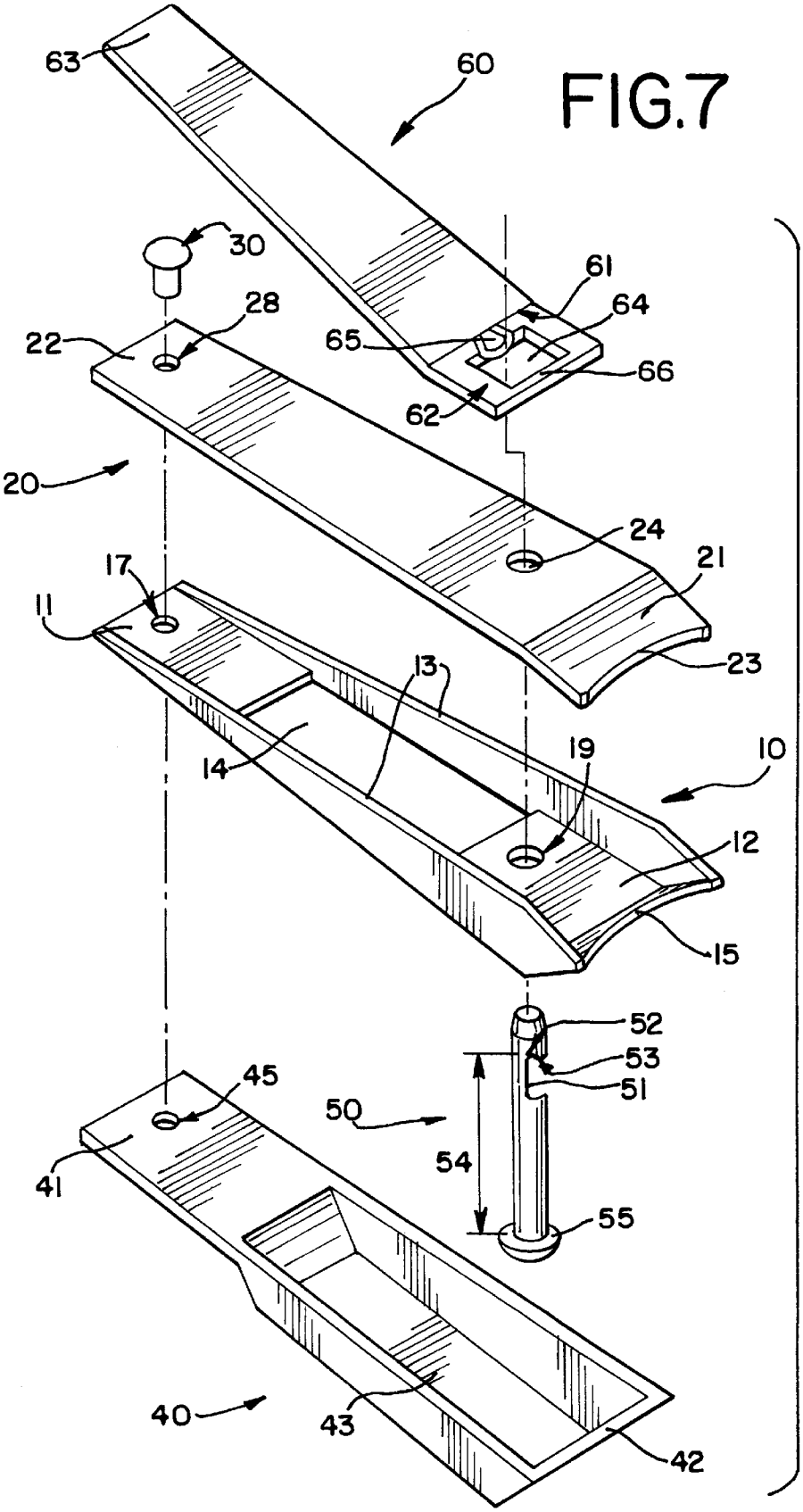
FIG. 7 is an exploded view of a preferred embodiment of the present invention where the upper arm member, the lower arm member and the receptacle are attached by a rivet.

Furthermore, the lower and upper arm members 10, 20 could be made from two separate pieces of material and attached at the rear end 22 and the rear section 11 of the lower and upper arm members 10, 20, respectively. In this instance, the two members are attached by any means, including adhesive or spot welding. Additionally, two holes 16, 25 could be provided, and a rivet 30 inserted through the holes 16, 25 to attach the arm members 10, 20 as shown in FIG. 7. The rivet 30 could also be replaced with a screw. The lower and upper arm members 10, 20 could also be attached by bending an end of one arm member around the other arm member as shown in FIG. 2.

There is further provided a receptacle 40 made from a single piece of material which comprises a rear end 41 and front end 42. The front end 42 further defines a cavity 43. The front end 42 of the receptacle 40 further defines a through-hole 44.

The device 1 also includes a retaining pin 50 which includes a groove 51 therein. At an end 52 of the groove 51, there is located a protuberance 53. Additionally, an actuating handle 60 is provided which has a bend 61 thereon defining a front section 62 and a rear section 63. The front section 62 further defines a knock-out portion 64, a protuberance 65, and a retaining rib 66.

Inserting the retaining pin 50 into the through-hole 44 of the receptacle 40, the opening 14 of the lower arm member 10 and the through-hole 24 of the upper arm member 20, the groove 51 of the retaining pin 50 engages the actuating handle 60 such that the rib 66 is retained in the groove 51 of the retaining pin 50. In order for the actuating handle 60 and the retaining pin 50 to remain engaged, a distance 54 between a retaining pin head 55 and the end 52 of the groove 51 must be such that the upper arm member 20 is springingly moved in the direction of the lower arm member 10, thereby applying the pressure necessary for the rib 66 of the actuating handle 60 to remain engaged with the retaining pin 50.

Figure 3:
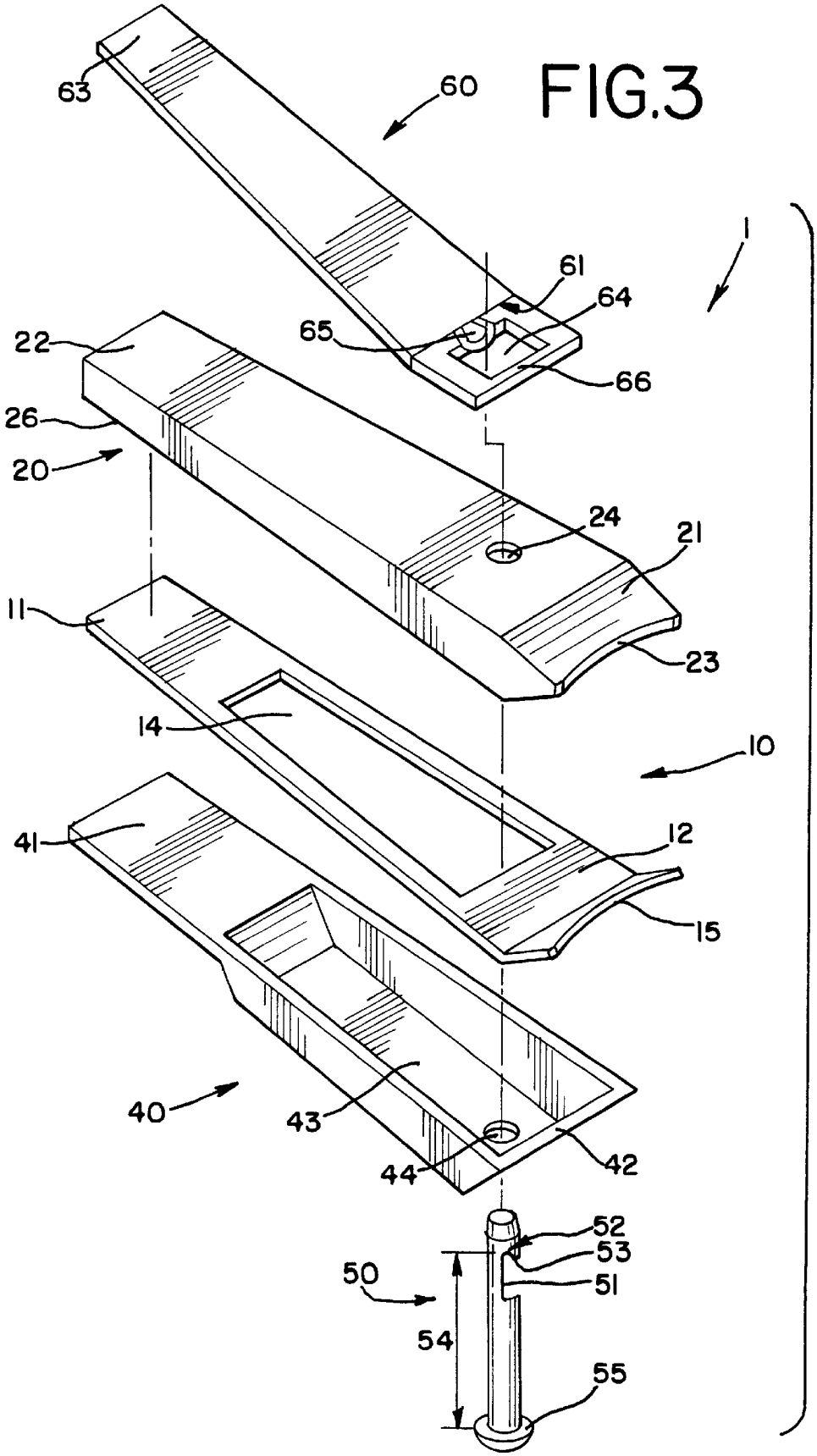
FIG. 3 is an exploded view of a preferred embodiment of the present invention with sidewalls on the upper arm member.

Additionally, as in FIG. 3, the upper arm member 20 may include a pair of sidewalls 26 and the lower arm member 10 omit sidewalls 13. Accordingly, the lower arm member 10 would be made from a flat piece of material which defines an opening 14.

Figure 4:
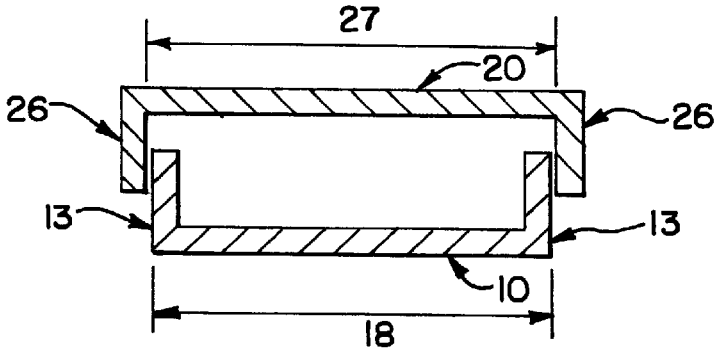
FIG. 4 is a sectional view of a preferred embodiment of the present invention where the sidewalls of the upper arm member are placed wider than the sidewalls of the lower arm member.
Figure 5:
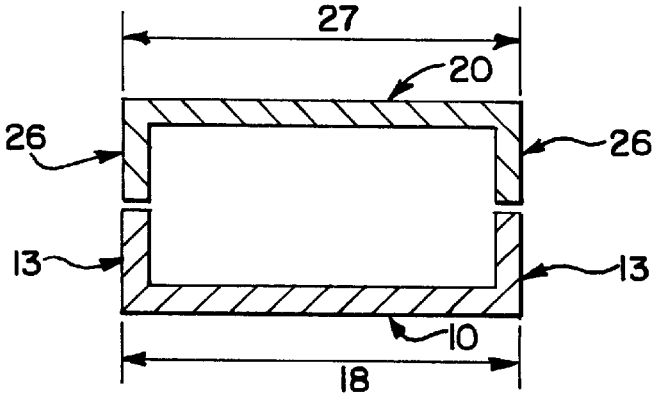
FIG. 5 is a sectional view of a preferred embodiment of the present invention where the sidewalls of the lower arm member are placed at equal width to the sidewalls of the upper arm member.
Figure 6:
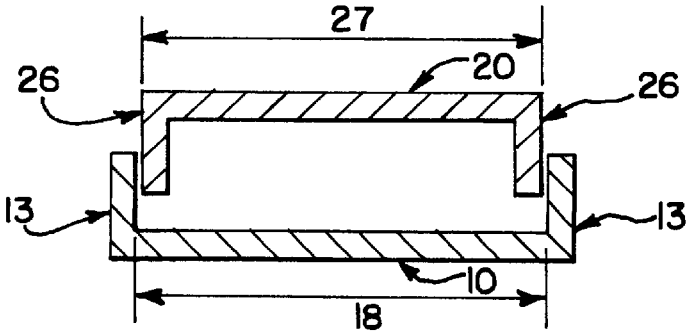
FIG. 6 is a sectional view of a preferred embodiment of the present invention where the sidewalls of the lower arm member are placed wider than the sidewalls of the upper arm member.

As in FIGS. 4–6, both the lower and upper arm members 10, 20 could have side walls 13, 26. The side walls 13 on the lower arm member 10 must be dimensioned such that the width 18 is smaller than (FIG. 4), equal to (FIG. 5), or larger than (FIG. 6) the width 27 of the side walls 26 of the upper arm member 20. In this manner, when the upper arm member 20 is moved toward the lower arm member 10, the side walls 26 of the upper arm member 20 will receive (FIG. 4), meet (FIG. 5), or be received by (FIG. 6) the side walls 13 of the lower arm member 10, respectively.

When the upper arm member 20 and the lower arm member 10 are made from separate pieces of material and attached by the rivet 30, as previously described, the rear end 22 of the upper arm member 20 could further define a through-hole 28 as in FIG. 7, and the lower arm member 10 could further define a through-hole 17 in the rear section 11. The receptacle 40 would define a through-hole 45 in the rear end 41 instead of the through-hole 44 of the front end 42. The receptacle 40 would then be attached to the lower arm member 10 by the rivet 30. The lower arm member 10 would define a through-hole 19 in the front section 12, and the retaining pin 50 would be inserted into the through-hole 19 in the lower arm member 10 and the through-hole 24 in the upper arm member 20 and engage the rib 66 of the actuating handle 60.

Figure 8:
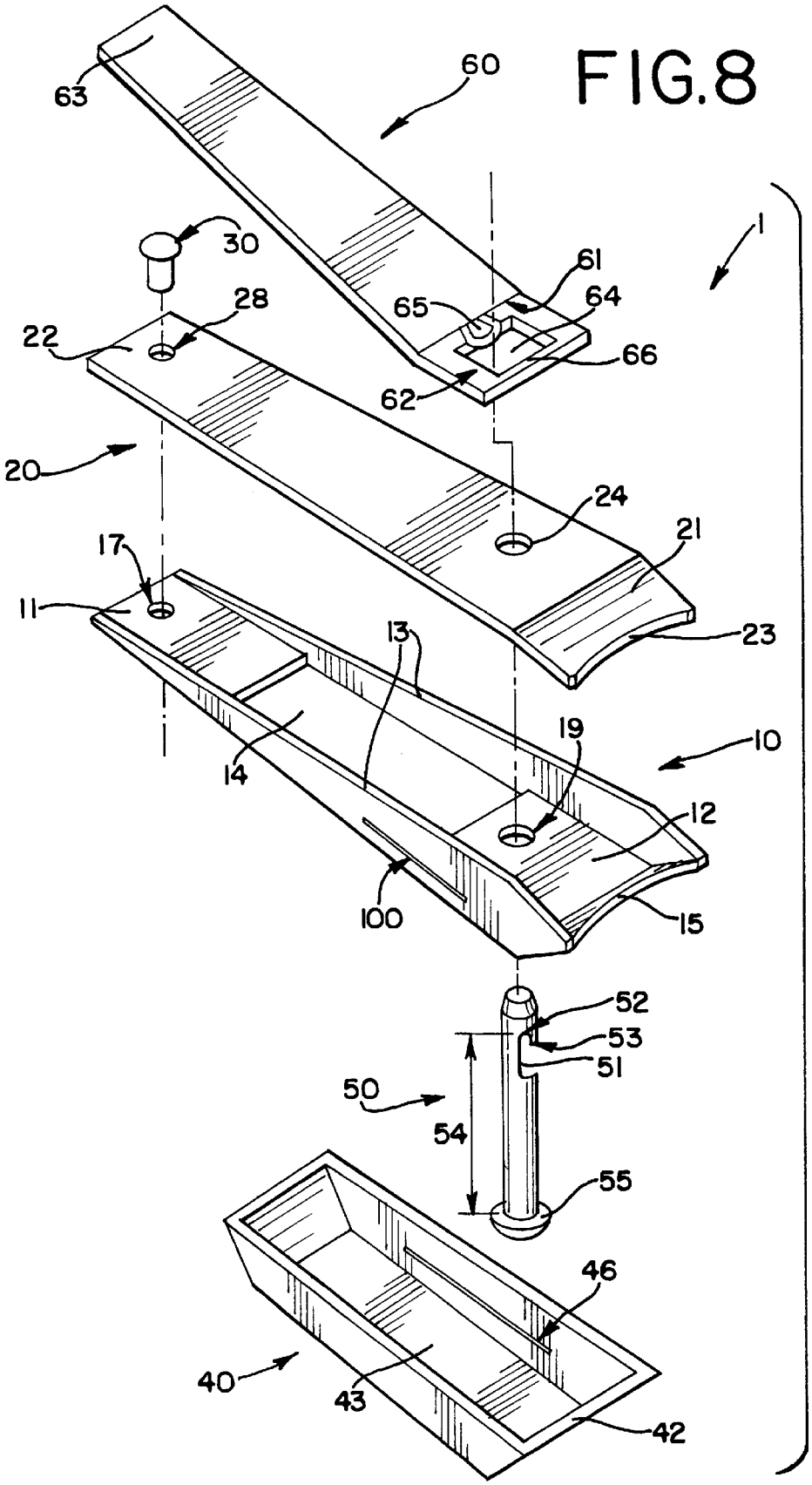
FIG. 8 is an exploded view of a preferred embodiment of the present invention where the upper arm member and the lower arm member are attached by a rivet and the receptacle is attached to the lower arm member by two pair of resilient ribs.

As shown in FIG. 8, the receptacle could also include a pair of opposed resilient ribs 46 located on the inner surface of the cavity 43 of the receptacle 40. Likewise, the outer surface of the lower arm member 10 also includes a pair of ribs 100. The receptacle 40 could then be attached to the lower arm member 10 by pushing the ribs 46 over the ribs 100. The receptacle 40 would then be attached to lower arm member 10.

The present device 1 is utilized by inserting the nail to be cut between the corresponding cutting edges 15, 23 of the upper arm member 20 and the lower arm member 10. The operator then applies pressure to the actuating handle 60, thereby pushing the actuating handle 60 toward the upper arm member 20. The actuating handle 60 then acts as a lever, with the rib 66 acting as the fulcrum. The protuberance 65 of the actuating handle 60 then pushes on the upper arm member 20 and springingly moves the upper arm member 20 toward the lower arm member 10 until the cutting edge 15 and the cutting edge 23 shear the nail between them.

With the two cutting edges 15, 23 in contact with each other, the cut portion of the nail is completely enclosed within the lower arm member 10, the upper arm member 20, the sidewalls 13, 26 and the receptacle 40. In this manner the cut portion will be completely contained within the device 1 and will fall into the receptacle 40 for later removal.

When the user of the device 1 has completed clipping nails, the user may empty the receptacle 40 of the device as shown in FIGS. 1, 3, and 7 by rotating the receptacle 40 in relation to the lower arm member 10 and inverting the nail clipper 1. After emptying, the user must rotate the receptacle 40 back to its original position directly beneath the opening 14 of the lower arm member 10, and the device 1 is once again ready for clipping nails.

In order to empty the device 1 as shown in FIG. 8, the user must remove the receptacle 40 from the lower arm member 10 by urge the ribs 46 over the ribs 100. The user may then empty the clippings from the receptacle and reattach the receptacle by urging the ribs 46 back over the ribs 100. The device will then be once again ready for use.

Preferably, the upper and lower arm members 20, 10 are made of stainless steel, but could also be made from other metal or plastic materials. Preferably the receptacle 40 is made of a plastic material, but could also be made of stainless steel or other materials.

While the specific embodiments have been illustrated and described, numerous modifications come to mind without significantly departing from the spirit of the invention, and the scope of protection is only limited by the scope of the accompanying claims.

We claim:

1. A device for clipping nails and retaining clippings comprising:

a lower arm member defining an opening and a cutting edge at an end thereof;

an upper arm member springingly attached to the lower arm member, the upper arm member further defining a cutting edge in corresponding placement to the cutting edge of the lower arm member;

a receptacle for retaining nail clippings;

an actuating handle; and, a retaining pin connecting the lower arm member, the upper arm member, the receptacle, and the actuating handle wherein the receptacle is pivotally attached to the retaining pin.

2. The device of claim 1, wherein the upper arm member and the lower arm member are formed from a single blank.

3. The device of claim 1, wherein the upper arm member is attached to the lower arm member by bending an end of the upper arm member around an end of the lower arm member.

4. The device of claim 1, wherein the lower arm member includes a pair of sidewalls.

5. The device of claim 1, wherein the upper arm member includes a pair of sidewalls.

6. The device of claim 1, wherein the upper arm member and the lower arm member both include a pair of sidewalls.

7. The device of claim 1, wherein the upper arm member is attached to the lower arm member with a rivet.

8. A device for clipping nails and retaining the clippings comprising:

a body having a cutting member at one end for cutting nails;

an actuating member attached to the body for moving the cutting member from an open to a closed position;

a pin; and, a receptacle directly attached to the body with the pin for rotatable movement of the receptacle with respect to the body.

9. The device of claim 8, wherein the receptacle attaches to the body with a rivet.

10. The device of claim 9, wherein the rivet is located in the rear section of the lower arm member.

11. The device of claim 8, wherein the receptacle attaches to a pin at a front section of the body.

12. The device of claim 8, wherein the device further includes sidewalls.

13. The device of claim 8, wherein the body comprises:

a lower arm member having a cutting edge on a proximal end;

an upper arm member having a cutting edge on a proximal end;

a pair of opposed side walls; and, wherein the cutting edges of the upper and lower arm members are capable of cooperative engagement to shear a nail.

14. The device of claim 13, wherein the upper and lower arm members are integral.

15. The device of claim 14, wherein the upper and lower arm members are formed by folding a blank along a center portion of the blank.

16. The device of claim 8, wherein the upper and lower arm members are attached by a rivet.

17. The device of claim 8, wherein the upper and lower arm members are attached by an adhesive.

18. The device of claim 8, wherein the upper and lower arm members are attached by spot welding.

19. A device for clipping nails and retaining the clippings comprising:

a lower arm member defining an opening, a plurality of ribs, and a first cutting edge at an end thereof;

an upper arm member springingly attached to the lower arm member, the upper arm member further defining a second cutting edge in corresponding relation to the first cutting edge;

a receptacle for retaining nail clippings, the receptacle defining a cavity and a plurality of opposed resilient ribs located on the inner surface of the cavity, the receptacle being attached to the lower arm member by forcing the plurality of resilient ribs of the receptacle past the plurality of ribs of the lower arm member in a direction transverse to a plane defined by the opening of the lower arm member;

an actuating handle; and, a retaining pin connecting the lower arm member, the upper arm member, and the actuating handle.

20. The device of claim 19, wherein the device further comprises sidewalls.

21. The device of claim 19, wherein the upper arm member and the lower arm member are formed from a single blank.

* * * * *